United States Patent [19]

Sommer, Jr. et al.

[11] 4,031,004

[45] June 21, 1977

[54] FEED SYSTEM FOR AN ELECTROMAGNETIC EDDY CURRENT MATERIALS SEPARATOR

[76] Inventors: Edward J. Sommer, Jr., 1908 Beechwood Ave., Nashville, Tenn. 37212; Garry R. Kenny, Rte. 1, College Grove, Tenn. 37046; Frank S. Knoll, 4257 Melrose Ave., Jacksonville, Fla. 32210; David W. Mitchell, 3946 St. Johns Ave., Apt. 92, Jacksonville, Fla. 32205

[22] Filed: May 24, 1976

[21] Appl. No.: 689,662

[52] U.S. Cl. ..... 209/212; 209/231; 209/111.8; 209/73; 198/502

[51] Int. Cl.[2] ..... B03C 1/30

[58] Field of Search ..... 209/212, 231, 111.8, 209/73, 111.7; 198/502, 560

[56] References Cited

UNITED STATES PATENTS

| | | | |
|---|---|---|---|
| 2,461,592 | 2/1949 | Brabander | 198/502 |
| 3,341,837 | 9/1967 | Washington | 198/502 |
| 3,655,039 | 4/1972 | Kind | 209/111.8 |

FOREIGN PATENTS OR APPLICATIONS

| | | | |
|---|---|---|---|
| 1,478,768 | 1969 | Germany | 198/502 |

*Primary Examiner*—Hiram H. Bernstein
*Attorney, Agent, or Firm*—Mason, Fenwick & Lawrence

[57] ABSTRACT

A feed system is disclosed herein for use with an electromagnetic eddy current materials separator for supplying material to be acted upon by the eddy current magnet directly into the regions strongest influence of the magnetic field of said magnet. Automatic blockage release means are provided to terminate jam-ups in the event that a blockage should occur in the delivery of feedstock to the region of influence of the magnetic field of the magnet.

4 Claims, 21 Drawing Figures

Fig-1
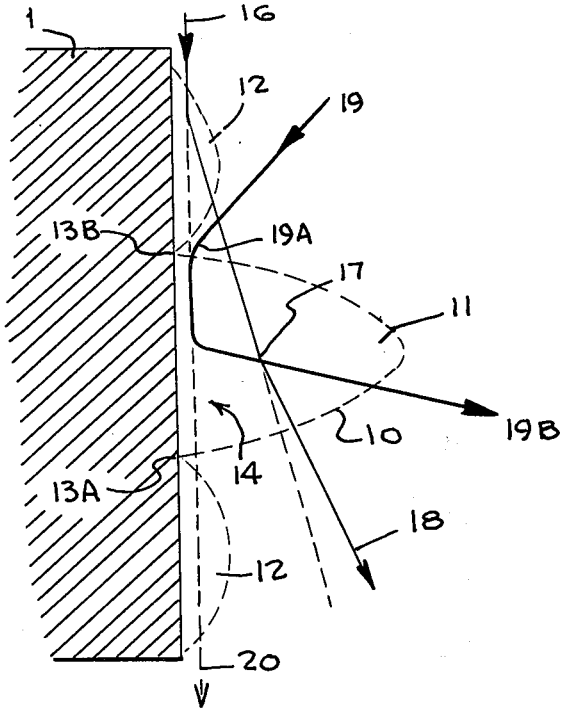
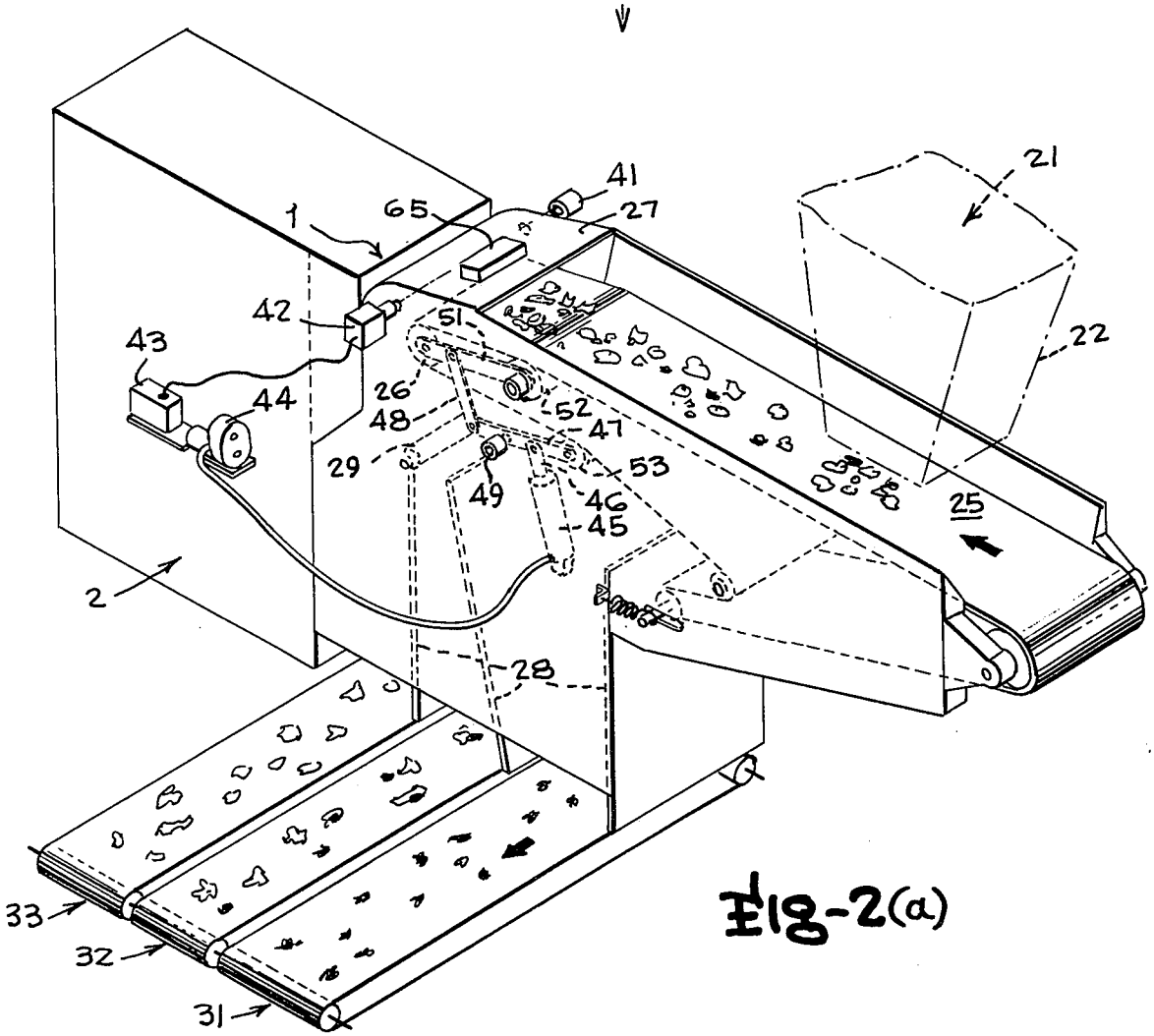
Fig-2(a)

FEED SYSTEM FOR AN ELECTROMAGNETIC EDDY CURRENT MATERIALS SEPARATOR

BACKGROUND OF THE INVENTION

1. Field of the Invention

This invention relates to the separation and classification of electrically conductive materials and to an apparatus and method for utilizing the principle of electrically induced eddy current repulsion as the means for accomplishing the separation of material. The invention is of particular importance in the separation of non-ferrous metallic articles from a mixture of non-ferrous metallics, ferrous metallics and non-metallics. For example, the invention is useful for the recovery of metal articles from municipal solid waste material.

2. Description of the Prior Art

In numerous situations, it is desirable to be able to separate materials according to their electrical conductivity, such as to separate metallic materials from non-metallic materials or to separate and distinguish between different metallic substances. The use of electromagnetically induced eddy currents to produce repulsive forces between an electromagnet and the material in which the eddy current is induced is one method for accomplishing such separation of materials. A rapid change in current through an inductor will produce a magnetic field the flux of which will be cut by any material lying within the resulting magnetic field. Since the flux varies with time and any conductive material within the field cannot link such a time varying flux, current is induced in the conductive material such as to produce a zero net flux passing through the material. This latter current, termed an eddy current, has a magnetic field associated with it, which magnetic field exerts a repelling force on the first magnetic field. Therefore, if the electromagnet is fixed in position and the other material is free to move, the material in which the eddy current has been induced will be repelled from the magnet. The repulsive force will vary directly with the value of the eddy current which will, in turn, depend upon, among other things, the electrical conductivity of the material.

In one embodiment of the electromagnetic eddy current materials separator, a mixture of particles of material with various electrical conductivity characteristics and magnetic properties may be projected through an intense unidirectional magnetic field with the line of motion of the particles essentially at 90° to the direction of the field and, in accordance with the above-mentioned principles, particles of greater conductivity will be decelerated to a greater extent than those of lesser conductivity, with the result that different kinds of particles will have different trajectories in emerging from the magnetic field, and separation of the particles will thereby be achieved. It will be understood that the effect on the conducting particles will be the same whether the particles move with respect to the field or whether the field moves with respect to the particles.

The aforementioned principles are well-known and have previously been employed for the purposes of separating and classifying materials. Prior apparatus and methods for adapting the principle of electromagnetic eddy current repulsion to the separation and classification of materials have been extremely inefficient in their use of energy, have suffered from blockage of the apparatus due to the presence of ferrous materials, and have achieved a poor degree of separation because of the scattering influence of the fringe fields of the electromagnet.

The most relevant example of a prior art system known to us is that disclosed in U.S. Pat. No. 3,448,857 to Benson et al. The Benson et al patent illustrates these disadvantages, as will become more apparent from the description of our invention which follows.

It is, accordingly, an object of the invention to provide and improved electromagnetic eddy current materials separator apparatus and method.

It is a further object of the invention to provide an electromagnetic eddy current materials separator apparatus and method which is highly efficient energy-wise and economical to operate.

It is a further object of the invention to provide an electromagnetic eddy current materials separator apparatus and method capable of efficient, economical and blockage-free operation with feedback containing ferrous metals.

It is another object of the invention to provide an improved electromagnetic eddy current materials separator capable of providing a more effective separation of materials based upon their electrical conductivities.

Another object of the invention is to provide a blockage-free feed system for supplying materials, including ferrous materials, to the electromagnet of an electromagnetic eddy current materials separator.

BRIEF DESCRIPTION OF THE FIGURES

FIG. 1 is a profile of the magnitude of the square of the intensity of the perpendicular component of the magnetic field of the eddy current magnet as a function of position across the face of the magnet;

FIG. 2 is a schematic illustration of the electromagnetic eddy current materials separator.

DESCRIPTION OF A PREFERRED EMBODIMENT

Figures 2B, 3:
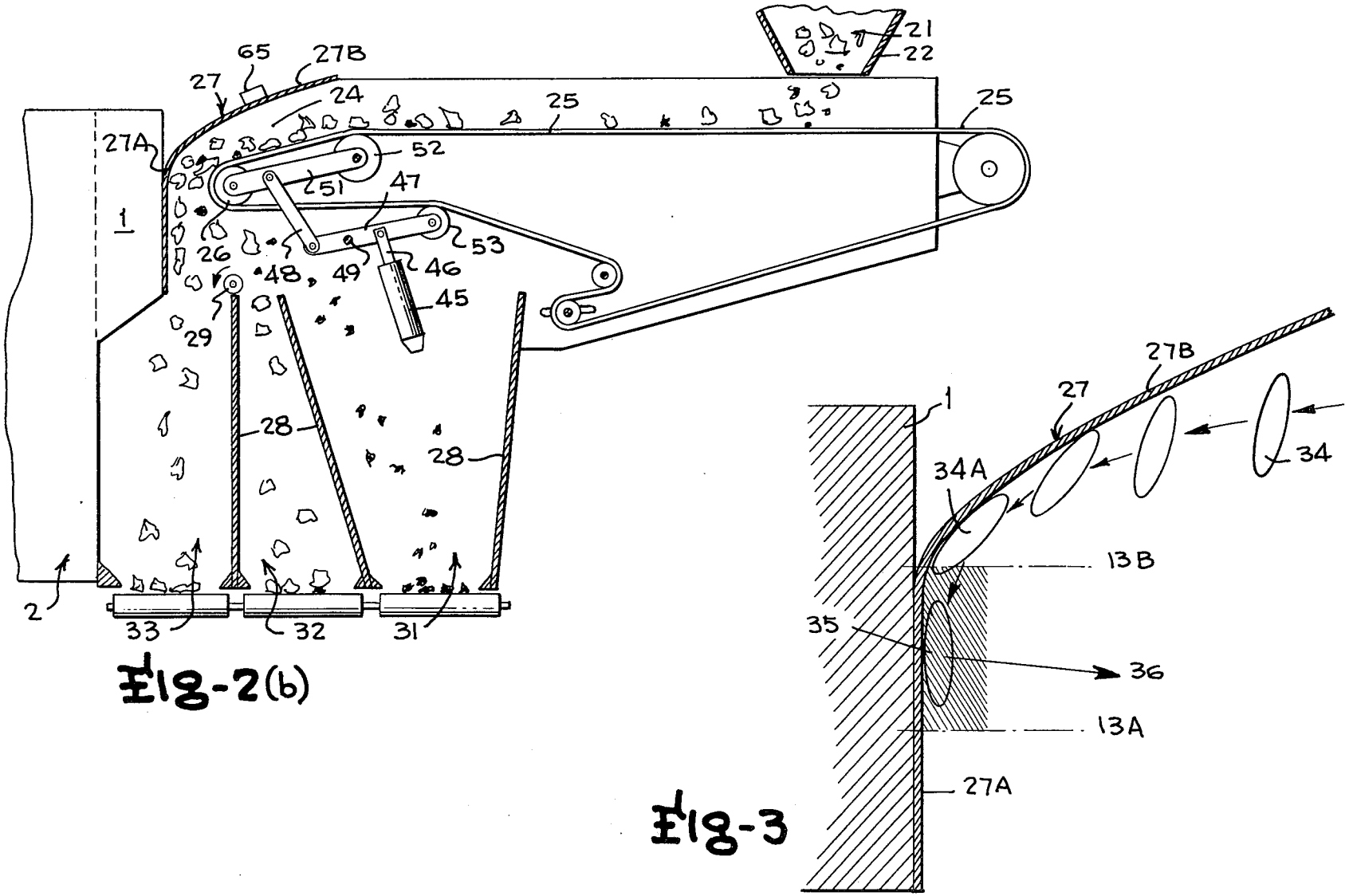
FIG. 3 is a schematic illustration of a side view of the deceleration slide and associated magnet.

The efficient separation of materials by an eddy current magnet depends on the proper introduction of such materials into the magnetic field of the eddy current magnet. Referring to FIG. 1, a portion of an eddy current magnet adjacent its working face is indicated by reference character 1, along with dashed line 10 representing the magnitude of the square of the intensity of the perpendicular component of the magnetic field produced by eddy current magnet 1 as a function of position across the face of the magnet. It will be observed that there is a central region 11 in which the strength of the perpendicular component of the magnetic field is greatest, bordered by side lobes (fringe field) 12 of lesser field strength, and a pair of points 13A and 13B separating the central region of strong magnetic field strength from the side lobes of lesser field strength, at which points the perpendicular component of the magnetic field is zero. The region between points 13A and 13B and close to the face of the eddy current magnet 1 is herein termed the region of strongest influence of the magnetic field 14.

All eddy current magnets have a region of fringe field surrounding a region in which the influence of the magnetic field is strongest, so the problem of introducing the feedstream into the region of strongest influence of the magnetic field in such a way as to avoid the fringe field is independent of specific magnet design. The magnitude of the square of the intensity of the perpendicular component of the magnetic field relates linearly to the repulsive force exerted on a body of non-ferrous metal as it traverses parallel to the face of the eddy current magnet 1. It has previously been the practice in the art to introduce the feedstream into the magnetic field of eddy current magnet 1 in the region of the fringe field 12, such as along the path indicated by line 16. The fringe field 12 would then exert a weak repulsive force on any non-ferrous metal in the feedstream, altering its trajectory slightly so that it travels to point 17 in the central region 11 of the face of the eddy current magnet 1. In the vicinity of point 17, the repulsive force felt by the non-ferrous metal due to the magnetic field of the eddy current magnet 1 is also weak, since the non-ferrous metal is relatively far removed from the face of eddy current magnet 1. Thus, the trajectory of the non-ferrous metal is only slightly altered by the repulsive force experienced in the vicinity of 17 and the metal assumes a final trajectory as shown by line 18.

In our invention, the feedstream is introduced to the field of eddy current magnet 1 along a path indicated by the line from point 19 to point 19A, which path lies outside fringe field region 12 and carries the feedstock directly into the region of strongest influence of the magnetic field 14. The trajectory of the feedstock in the vicinity of 19A is mechanically altered, as by deceleration slide 27, discussed below and shown in FIGS. 2 and 3, so that the feedstock, including the non-ferrous metals therein, enters the region of strongest influence of the magnetic field on a course parallel to the face of eddy current magnet. While in the region of strongest influence of the magnetic field, the non-ferrous metal experiences a strong repulsive force due to its interaction with the magnetic field, which repulsive force results in the non-ferrous metal being ejected from the region of strongest influence of the magnetic field on a trajectory as shown by line 19B. Because of weak fringe field repulsions, trajectory 19B is more favorable than trajectory 18 for separation of non-ferrous metals from a non-metallic and/or ferrous feedstream, the tailings of which will follow trajectory 20. Trajectory 19B is also more favorable for separating different non-ferrous metals from one another. FIGS. 3 and 11 illustrate some of the alternative methods by which the feedstream can be introduced to the eddy current magnet along path 19.

FIG. 2 depicts the eddy current separator in schematic form. Raw feedstock 21 is fed into the separator through input section 22. Input section 22 consists of apparatus for controlling the rate at which the input feedstock is supplied to conveyor 25, such as a direct gravity drop, a regulated screw or conveyor, a vibratory feeder, or a set of opposing rollers. Conveyor 25 accelerates the feedstock 21 to a desired velocity and transports it from input section 22 to eddy current magnet 1. The feedstock, after having been accelerated to the desired velocity, is discharged from conveyor 25 at head pulley 26 with sufficient momentum to encounter deceleration slide 27. Deceleration slide 27 consists of a curved sheet member having a first or downstream portion 27A which is substantially flat and is attached to the face of eddy current magnet 1, and a second or upstream portion 27B merging with the first portion 27A and extending upwardly and outwardly therefrom, in a direction away from the face of eddy current magnet 1, curving into and through the trajectory path of the feedstream 24 which is discharged from conveyor 25 at head pulley 26.

The feedstream trajectory is smoothly changed by deceleration slide 27 to the direction optimum for entry of the feedstock into the region near the surface of the eddy current magnet 1 where the interaction of the magnetic field with the feedstock will be strongest. Upon interaction with the magnetic field of the eddy current magnet 1, non-ferrous metals in the feedstream are repulsed transversely out of the feedstream into the product stream 31 or the middling stream 32 and are collected in corresponding repositories. Non-metallics and ferrous metals are not repulsed by the magnetic field of the eddy current magnet 1 and will fall into the tailings stream 33.

Figure 4A:
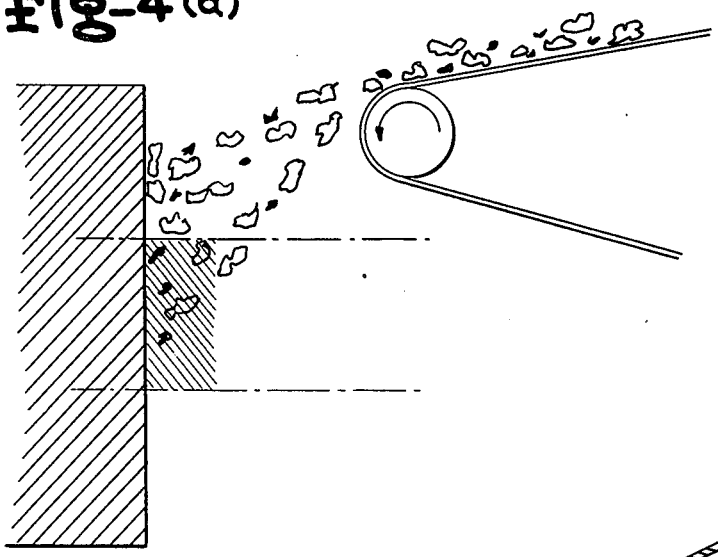
FIGS. 4*a* and 4*b* are schematic illustrations showing the effect of the deceleration slide on the trajectories of the particles in the feedstream.
Figure 4B:
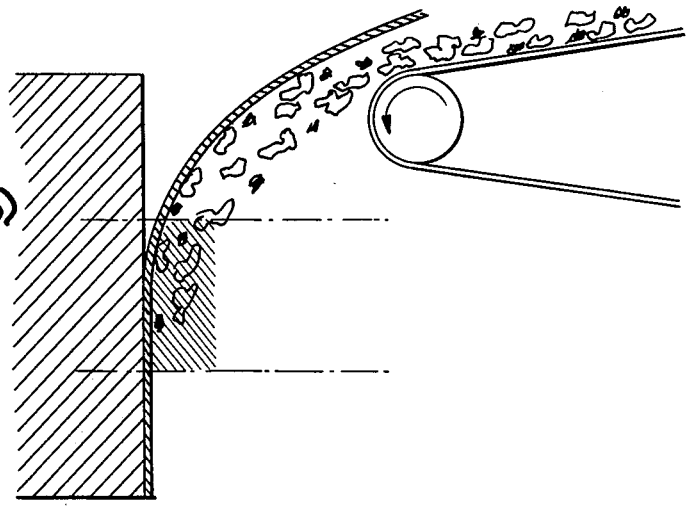

The use of a deceleration slide 27 or similar means for introducing the feedstream to the eddy current magnet 1 along trajectory 19 has three principal advantages. Referring to FIG. 3, the first principal advantage is that predominately two-dimensional input non-ferrous metals 34, such as flattened aluminum cans, are caused by the deceleration slide 27 to align themselves, as at 34A, to maximize their area of cross-section to the perpendicular component of magnetic field from the eddy current magnet 1 during their entry to the region of strongest influence of the magnetic field 14. FIG. 3 illustrates the progressive alignment of a typical flattened aluminum can. For such alignment, the probability of weak repulsion and the consequent inability of the aluminum can to penetrate to the region of strongest influence of the magnetic field is minimized. Following this entry alignment, the aluminum can is aligned, as at 35, by deceleration slide 27 so that it presents the greatest area of cross-section to the magnetic field of the eddy current magnet 1 when in the region of strongest influence of the magnetic field 14, thereby maximizing the repulsive force given to the aluminum can while in that region. The result is a more positive and more efficient separation of the aluminum can from the feedstream, along the trajectory designated 36. The second principal advantage to the use of a deceleration slide 27 is that it minimizes fanning of the feedstream after discharge of the feedstream from conveyor 25 at head pulley 26. Typical fanning following discharge of feed from head pulley 26 is shown in FIG. 4*a*, in which no deceleration slide is utilized, and in FIG. 4*b*, in which a deceleration slide has been added. It can be seen from FIG. 4*a* that the feedstream fans out after discharge from conveyor 25 and overlaps into the fringe field region 12 of the eddy current magnet 1. Only a part of the feedstream enters directly into the region of strongest influence of the magnetic field 14. If the geometry of the feeding is altered, as by slowing the conveyor, so that the top portion of the fanned out feedstream enters directly into the region of strongest influence of the magnetic field 14, then the lower portion of the fanned out feedstream passes by the region of strongest influence of the magnetic field at too far a distance from the surface of the eddy current magnet 1 to receive a repulsive force sufficiently strong to effect a separation. By adding a deceleration slide 27, as shown in FIG. 4*b*, the flow of the feedstream 24 may be directed away from the fringe field region 12 and into the region of strongest influence 14 of the magnetic field of eddy current magnet 1. Thus, interaction of non-ferrous metals within the feedstream 24 with the fringe magnetic field region 12 is avoided, thereby avoiding detrimental weak repulsion, in addition to all the feedstock being directed into the proper region of the field of the eddy current magnet 1, namely the region of strongest influence of the magnetic field 14. The third principle advantage to the use of a deceleration slide 27 is that the trajectory of feedstream 24 is mechanically altered by specially designed deceleration slide 27 so as to smoothly change the direction of flow of the feedstream so that it passes over the central region of the eddy current magnet parallel to the face of the magnet in such a manner so as to minimize mechanical bouncing of feedstream materials off the face of the eddy current magnet.

This method of introducing the feedstream into the field of the eddy current magnet also minimizes the carryover of tailings into the non-ferrous metals product, resulting in a cleaner separation of the non-ferrous metals from the tailings. Since non-ferrous metals are ejected from the feedstream in a direction perpendicular to the face of the eddy current magnet 1 and, therefore, perpendicular to the plane of the feedstream, such non-ferrous metals upon ejection need travel only through the thinnest dimension of the feedstream before moving free of the feedstream. Other eddy current separators presently in use extract the non-ferrous metals laterally through the thickest section of the feedstream, thereby maximizing encounters with tailings and other feedstock and resulting in increased carryover of tailings into the product non-ferrous metals.

Automatic blockage release means are provided to terminate jam-ups in the event that a blockage should occur between conveyor 25 and acceleration slide 27. Such blockage would be detected in the illustrated embodiment by means of light 41, photocell 42 and processing electronics 43, which will turn on hydraulic or pneumatic fluid pump 44, thereby increasing the pressure in fluid-actuated cylinder 45 and extending piston rod 46 coupled to rigid member 47. This will result in pulley 53 being raised, which motion will be transmitted via rigid members 47, 48 and 51 to head pulley 26. Rigid member 47 is pivoted at point 49. Thus, head pulley 26 will be lowered and retracted while a constant conveyor belt tension is maintained by pulleys 52 and 53, thereby allowing the material causing the blockage to fall into the tailings.

Middling products may be made to increase the efficiency of separation. In general, the separate collection of middlings and their subsequent recycling through the separator permits recovery of most of the metallic content of the middling into the metal concentrate.

The effectiveness and efficiency of repulsion of non-ferrous metals by the eddy current magnet 1 also depends upon the method of activation of the eddy current magnet by power section 2. In contradistinction with the prior art, which utilized a single, relatively large current pulse to activate the eddy current magnet 1 during that period of time in which a given point in the feedstream would be within the field of influence of the magnet, this invention employs a plurality of relatively low amplitude current pulses to activate the magnet. These low current pulses are typically each of a value too small to give rise to sufficient repulsive force to effect separation of a non-ferrous metal from the feedstream; however, the cumulative effect of a plurality of successive impulses is sufficient to effect separation of non-ferrous metal from the feedstream.

For the typical embodiment herein illustrated, feedstream velocity across the surface of the eddy current magnet is about 5 feet per second. If the region of strongest influence of the magnetic field is about 3 inches wide in the direction of travel of the feedstream, as in a typical installation, the transmit time of a point moving in the feedstream within the magnetic field is on the order of 50 milliseconds. Further, it has been observed that non-ferrous metals repelled by the magnetic field of the eddy current magnet 1 are carried out of the region of strongest influence of the magnetic field in approximately 8 milliseconds. In order to utilize a single high-current pulse to power the eddy current magnet, as in Benson et al Pat. No. 3,448,857, it is necessary to use switching devices which are incapable of the repetition rates required to allow a reasonable volume of feedstream through-put without capital costs being prohibitively high. By employing a plurality or series of lower-current pulses to activate the eddy current magnet, according to our invention, it is possible to overcome this disadvantage of the prior art.

Figure 5:
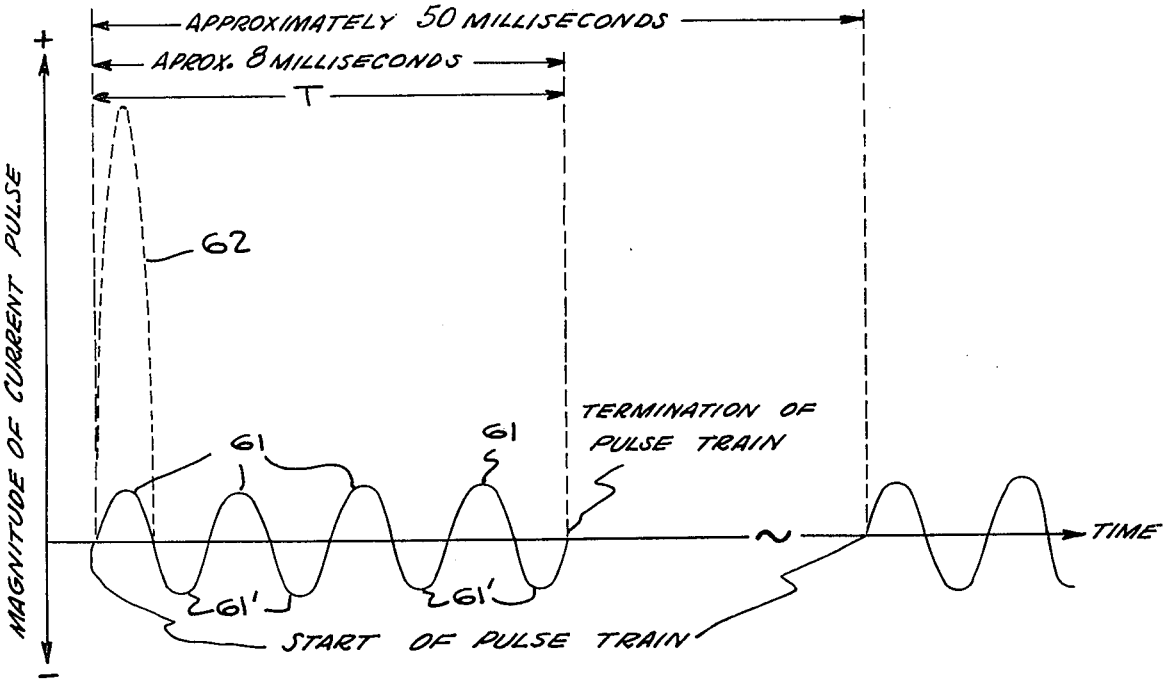
FIG. 5 is a timing diagram showing the current through the eddy current magnet.

FIG. 5 shows how the current used to energize the eddy current magnet is varied as a function of time. The pulses used to activate the magnet may all be of either positive polarity or all of negative polarity or any combination of the two, since the repulsive force between the magnetic field and any non-ferrous metals in the feedstream is independent of the direction of the magnetic field. Current pulses 61 and 61′ may for example, alternate in polarity as illustrated. In one embodiment, power unit 2, described in more detail below, permits electrical energy which is switched through the eddy current magnet 1 in the forward direction, as for positive current pulses 61, to be reflected back through eddy current magnet 1 in the reverse direction, producing negative current pulses 61′, without the additional input of energy into the pulse train. Current pulses 61, 61′ may follow one another in a continuous manner or they may be discrete pulses having an off time between pulses as, for example, to allow recovery time for the apparatus generating the pulses. The duration T of the pulse train 61, 61′ must be long enough to provide for efficient and effective repulsion of non-ferrous metals from the feedstream, but not much longer, since it is a waste of energy to turn on eddy current magnet 1 when there is no non-ferrous metal in the region of strongest influence of its magnetic field 14. Duration T depends upon the transit time of a given point in the feedstream through the region of strongest influence of the magnetic field, or upon the transit time for non-ferrous metals to leave the region of strongest influence of the magnetic field due to eddy current repulsion, whichever is briefer. As explained above, for the feedstream velocity and eddy current magnet geometry used in an exemplary embodiment, these times are typically 50 milliseconds for feedstream transit and 8 milliseconds for eddy current repulsion of non-ferrous metals out of the strongest region of influence of the magnetic field. Thus, in the preferred embodiment, the duration T for the pulse train 61, 61' is 8 milliseconds. Of course, a variation in the relevant parameter values may require different pulse train duration; in general, for effective separation of non-ferrous metals from the feed-stream, the transit time for eddy current repulsion of non-ferrous metals from the feedstream will be somewhat less than the transit time of a point in the feedstream across the face of the eddy current magnet.

If it is desired that, at some time, all the input from feedstock in the feedstream be acted upon by the magnetic field of the eddy current magnet 1, the time between the initiation of pulse trains or, equivalently, the pulse train repetition rate, will be determined by the transit time of a given point in the feedstream across the region of strongest influence of the magnetic field. For the preferred embodiment, the transit time is 50 milliseconds, so that a pulse train repetition rate of 20 pulse trains per pulse train and the magnitude of the current pulses may preferably be adjustable, since required magnetic field strength depends upon the nature of the materials present in the feedstock. Inasmuch as it is an object of this invention to utilize the minimum power required to effect efficient separation of non-ferrous metals from the feedstream, it is desirable to be able to use a minimum amount of power to energize the eddy current magnet. For the example described above, power is supplied to the eddy current magnet for 8 milliseconds out of every 50 milliseconds. Therefore, for an assumed pulse amplitude which is the same for the current pulses 61, 61' supplied for 8 milliseconds as for the pulses for a continuously pulsed eddy current magnet of the prior art, it will be observed that power consumption for this intermittently pulsed example would be 16 percent of that required by such prior art system. An even greater savings in power may be achieved by using current pulses of lesser amplitude in the intermittently pulsed system or by reducing further the duty cycle.

This invention also produces a solution to the problem of blockage of the feedstream by entrapped ferrous metals, a situation common in other systems which employ a continuously powered eddy current magnet. In our invention, during the time when the eddy current magnet 1 is deactivated, ferrous metals which had been entrapped in the magnetic field of said eddy current magnet during pulse train 61, 61' are no longer entrapped, since there is no magnetic field, and are carried out of the region of influence of the magnetic field by gravity, into the tailings of the feedstream. Therefore, the invention can efficiently process feedstock containing ferrous metals.

The method described above for activating the eddy current magnet 1 can be modified, so that eddy current magnet 1 is activated only when non-ferrous metals are present in the region of strongest influence of the magnetic field. This may be accomplished by detecting metals in the feedstream by use of a metal detector and activating the power unit 2 only upon a signal from the metal detector that metals are detected in the feedstream. The metal detector 65 may, for example, be located externally to the eddy current magnet region, adjacent the feedstream at a point upstream of the eddy current magnet. With knowledge of the velocity of the feedstream and the distance between the metal detector 65 and the region of strongest influence of the magnetic field 14 of eddy current magnet 1, a proper time lag may be introduced between the occurrence of the detection signal from the metal detector and the time at which power unit 2 is activated, so that the metallics which were detected by the metal detector 65 will be within the region of strongest influence of the magnetic field 14 at the time eddy current magnet 1 is activated. Similarly, the metal detector may be placed directly in the region of strongest influence of the magnetic field, and activation of the eddy current magnet initiated immediately upon metal detection. As a further modification, the eddy current magnet itself may serve as the metal detector by maintaining a low level field in the eddy current magnet and monitoring changes in that field due to the presence of metallics. Such use of a metal detector to determine activation time of the eddy current magnet results in considerable energy savings; for example, studies indicate that the duty cycle of the eddy current magnet could reasonably be as low as one or two percent for processing municipal solid waste. The use of a metal detector also permits the precise positioning of the non-ferrous metals into the region of strongest influence of the magnetic field, assuring optimum eddy current repulsion of the non-ferrous metals and resulting in more efficient and more positive separation of the non-ferrous metals from the feedstream. Additionally, it is possible to distinguish between ferrous and non-ferrous metallics with the metal detector.

Once the non-ferrous metals have been repelled out of the feedstream by eddy current magnet 1, they may be recovered by the retrieval sub-system. As illustrated in FIG. 2, a plurality of stream splitters 28 are provided for optimally dividing the non-ferrous metals products from the tailings and the middling fraction. Stream splitters 28 may, for example, be planar divider members such as shown in FIG. 2, physically separating the product stream emerging from the region near the face of eddy current magnet 1 into multiple, isolated product streams, for example three streams 31, 32 and 33. The product stream furthest from eddy current magnet 1 will consist of non-ferrous metallics which have been repelled out of the feedstream by the magnetic field; the product stream closest to eddy current magnet 1 will consist of non-metallics which have not been repelled by the magnetic field and ferrous materials which had been attracted by the magnet; the product stream between the latter two will consist of a combination of materials having some non-ferrous metallic content, as well as some non-metallic. These latter products are collectively known as the middling fraction. An active roller 29 is situated above the stream splitter 28 dividing the tailings from the middling fraction. Active roller 29 is rotated in a direction such as to put into the tailings any materials which may lay across said roller.

Figure 6:
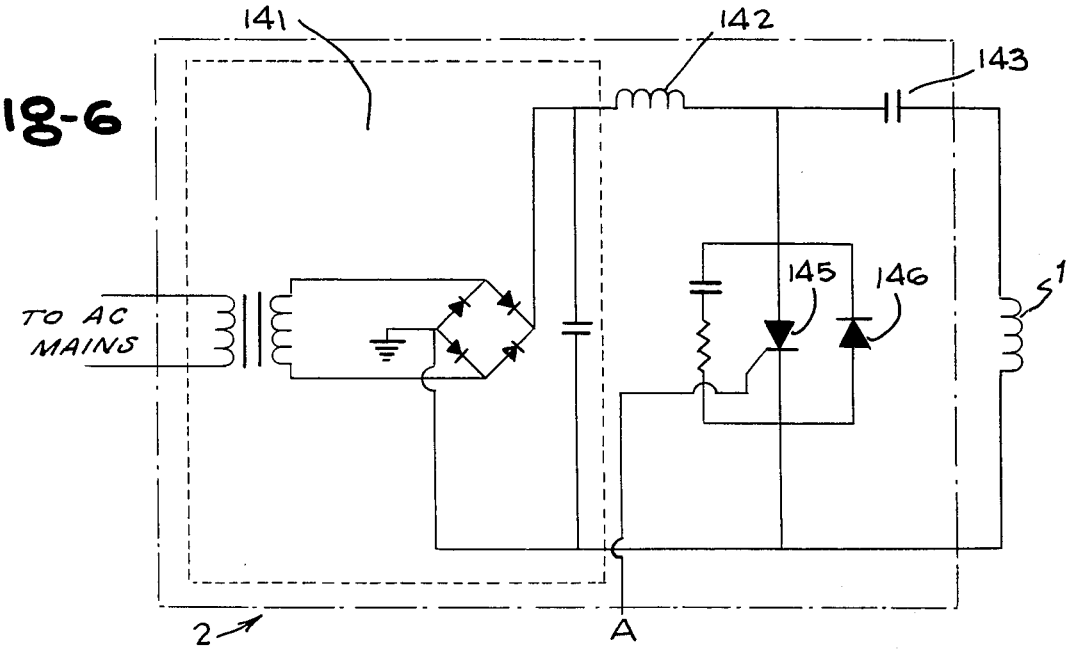
FIG. 6 is a schematic circuit diagram of a power unit for energizing the eddy current magnet.
Figure 7A:
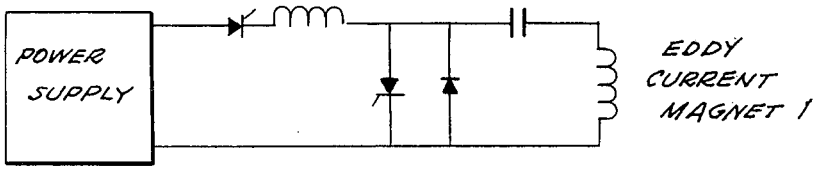
FIGS. 7*a* through 7*e* are block-schematic circuit diagrams of alternative embodiments of a power unit for energizing the eddy current magnet.
Figure 7B:
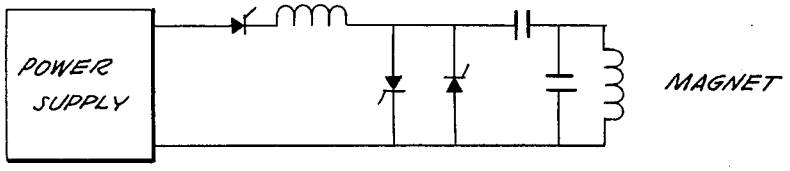
Figure 7C:
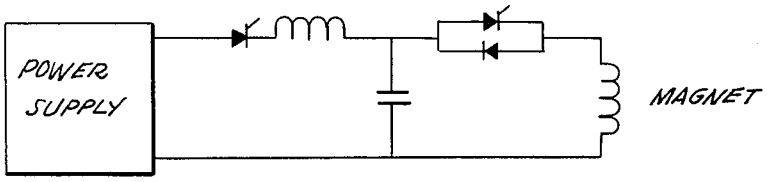
Figure 7D:
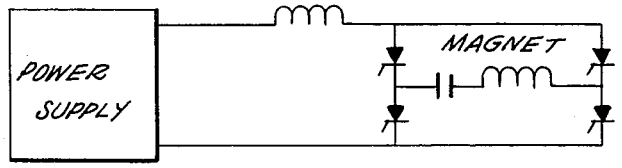
Figure 7E:
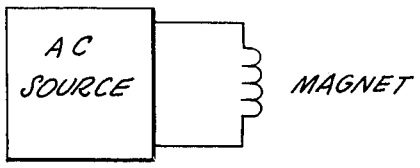

Power unit 2 supplies current pulses to eddy current magnet 1, as described earlier. FIG. 6 shows a schematic diagram of one example of a circuit which can be used for power unit 2. In operation, power supply 141 supplies current to charge capacitor 143 through eddy current magnet 1 and a charging inductor 142. Upon a signal from a metal detector, as discussed above, or at a predetermined time, a pulse may be applied to lead A connected to the gate of the silicon controlled rectifier (SCR) 145. SCR 145 then turns on, allowing charged capacitor 143 to discharge through eddy current magnet 1, providing the first pulse in the pulse train. When capacitor 143 has been discharged, all of the energy previously stored therein will have been transferred to the magnetic field of eddy current magnet 1, except for that energy dissipated resistively and that energy transferred to any non-ferrous metals which had been situated within the region of influence of the magnetic field of the eddy current magnet. The magnetic field of eddy current magnet 1 then begins to collapse, driving additional current through the magnet until all of the energy stored in the magnetic field is used up in charging capacitor 143. The charge on capacitor 143 at such time will be opposite to the charge it previously held. Current then ceases to flow through eddy current magnet 1 and the first pulse through said magnet is then completed.

With no current flowing through magnet 1, the reverse voltage across capacitor 143 appears across SCR 145 as a reverse voltage, initiating communication of the SCR. This voltage also appears across diode 146 as a forward voltage, turning on that diode. The electrical energy stored in reversely charged capacitor 143 thereupon produces a current in eddy current magnet 1 and capacitor 143, generating a second reverse current phase through eddy current magnet 1.

Forward charging of capacitor 143 is aided by current supplied from power supply 141 through feed inductor 142 to compensate for whatever energy may have been lost. The rate of this charging from power supply 141 is controlled by the value of inductance of feed inductor 142; the inductance of feed inductor 142 should be large enough that the charging rate does not hinder commutation of the SCR 145 during this time.

The above-described sequence is repeated during the pulse train duration T as many times as is necessary to generate the desired number of pulses. The pulse train is then terminated while new feedstock moves into position over the face of the eddy current magnet 1, at which time it will begin again.

Typical values for the current pulses through the eddy current magnet 1 may be 2,000 amperes, with a pulse width of 100 microseconds and a pulse train duration, T, of 10 milliseconds. Another example is 6000 amperes of current and the same pulse width for a pulse train duration, T, of 1 millisecond. These examples correspond to the same eddy current repulsion effectiveness as that attained by using a single, half-wave current pulse of 20,000 amperes and a 100 microsecond pulse width. Typical corresponding magnetic field strengths for these three cases, are, respectively, 3000 Gauss, 9000 Gauss and 30,000 Gauss.

The embodiment shown in FIG. 6 is a form of a series inverter wherein the eddy current magnet 1 serves as an inductive load. This is but one of many techniques for generating pulse trains to activate the eddy current magnet 1 and is intended to be of exemplary value only, not to limit the scope of the invention. Those skilled in the art will appreciate that there are other circuits equally useful for the same purpose. For example, some other suitable circuits are illustrated in FIG. 7, in which it is to be understood that the SCR's are gated by signals equivalent to those providing the gating at lead A in FIG. 6 and that said SCR's are properly protected from voltage transients. FIG. 7(*e*) shows the general case wherein an A.C. source puts out a continuous A.C. current when turned on and is capable of being turned on and off at times appropriate to generate the pulse trains described herein for the pulse train duration T.

Figure 8:
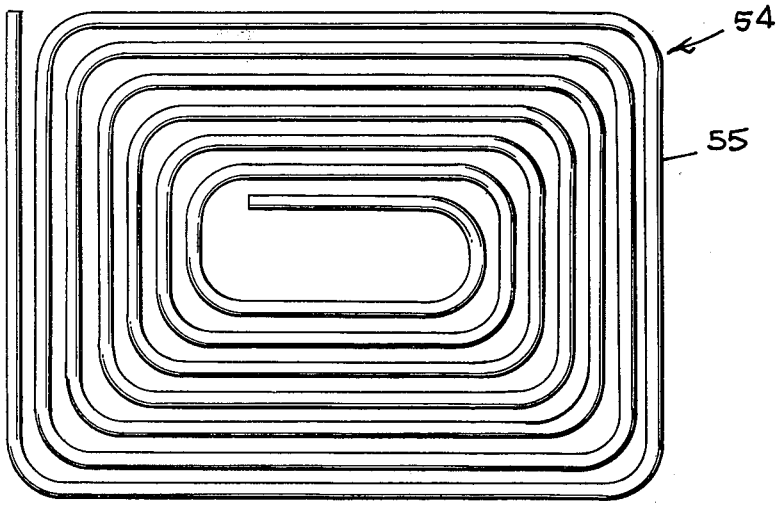
FIG. 8 is a plan view as an example of a suitable eddy current magnet winding configurations.

There are numerous designs for the eddy current magnet 1 which will suffice for operation in the invention. A typical example which provides satisfactory operation with adequate cooling is shown in FIG. 8 and employs a flat pancake coil 54 wound from round, hollow copper tubing 55. The hollow interior of the copper tubing is coupled to a water pumping circuit for flow of water through the tubing and allows for water cooling of the magnet. A supporting structural form, or framework not illustrated, should be provided to prevent movement of the turns of the coil relative to each other as electrical current passes through it.

Figure 9:
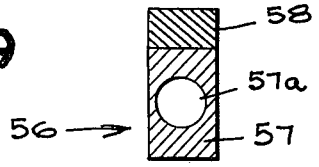
FIG. 9 is a transverse section view of another form of conductor which may be used for the magnet coil.

Alternatively, a hollow, lamenated conductor 56 as illustrated by the transverse section in FIG. 9, may be used for the magnet winding 54 in place of round, hollow copper tubing 55. Lamenated conductor 56 may, for example, be made of a steel support or backing layer 57 having a bore 57A for the cooling fluid, with a copper conductor 58 affixed to said support 57. The relative sizes of the steel and copper components of the laminated conductor 56 may be adjusted for resistivity and skin depth effects so that the electrical current flows almost entirely through the low impedence copper portion of the magnet winding. Thus, the current path through the magnet may be predominently located near the face of the magnet, as near as possible to the feedstream, thereby maximizing the inductive coupling between the magnet and the feedstock.

The performance of the electromagnetic eddy current materials separator depends to some degree upon the composition of the feedstock to be acted upon. Typical feedstock to be processed would comprise particles of approximately ½ to five inches across their longest dimension with a feedstock density of about 5 lbs./cu. ft. to 60 lbs./cu. ft. Moisture content may vary greatly. A breakdown of typical feedstock composition in municipal solid waste processing would contain about 65 percent organic material, 7 percent inorganic material (ceramics, stones, glass, etc.), 2 percent ferrous metals, 8 percent aluminum, 3 percent other non-ferrous metals, and 15 percent water. A separator designed to recover primarily aluminum can stock from the composition described is capable of recovering over 75 percent of the aluminum can stock present in the feedstock, with 95 percent purity.

It is preferable to prepare raw refuse which is to be fed into the separator by first shredding it in a conventional shredder, removing ferrous metals therefrom by conventional methods, extracting the heavy fraction of the remaining refuse (metals, paper, plastics, foodstuffs, etc.), and then screening it for proper size particles within the size which can be efficiently processed by the separator. Alternatively, the raw refuse can be processed by the separator without such preliminary preparation, although the product recovered will probably be lesser in amount and purity than if it were so prepared.

Figure 10:
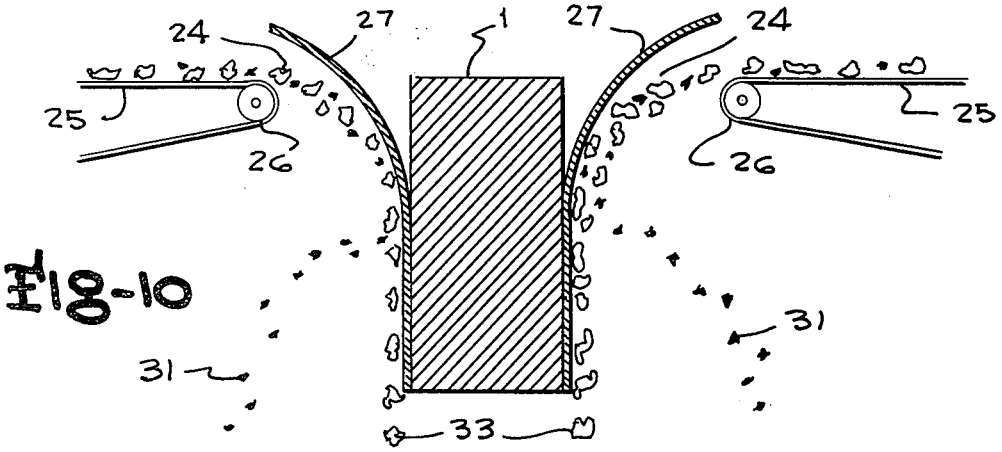
FIG. 10 is a schematic illustration of an alternative embodiment in which feedstock is supplied to both sides of the eddy current magnet.
Figure 11A:
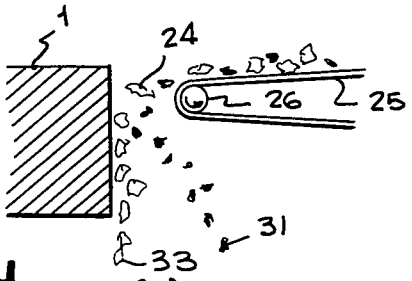
FIGS. 11*a* through 11*e* are schematic illustrations of some alternative methods for feeding material to the eddy current magnet.
Figure 11B:
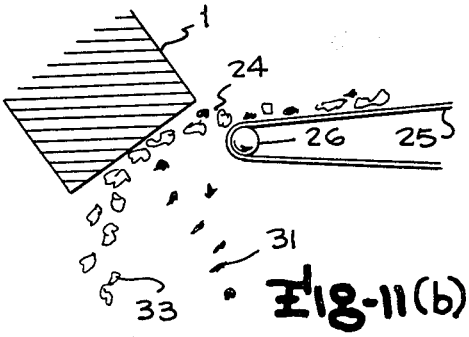
Figure 11C:
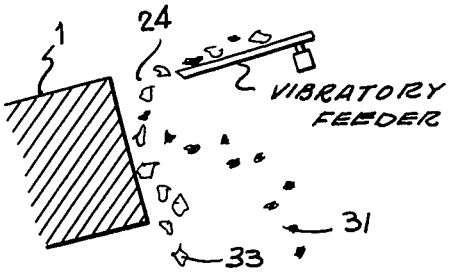
Figure 11D:
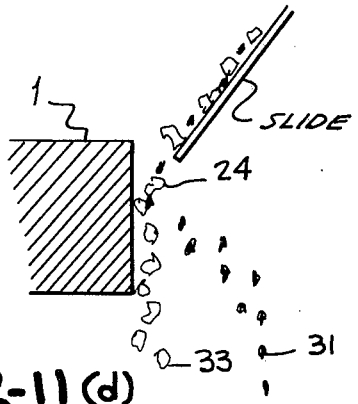
Figure 11E:
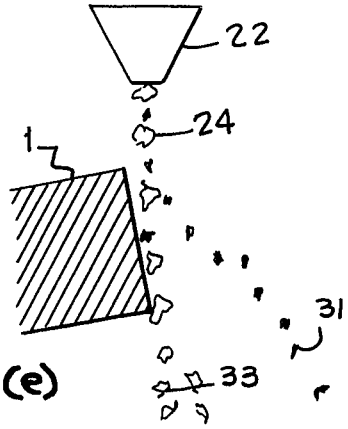

A further increase in the efficient use of the power used to generate the magnetic field may be achieved by supplying feedstock to both sides of eddy current magnet 1, as illustrated in FIG. 10. This permits the feed processing rate to be doubled, with only a small increase in power consumption by the power unit 2 used for activating the magnet. Such feeding is possible because, as with any dipole magnet, the eddy current magnet has two poles, either of which is as effective as the other causing eddy current repulsion.

Any number of such magnets may be used in a given separator depending on the design application of the separator, and pluralities of such magnets may be combined in various arrays. For example, in some cases it may be desirable to arrange an array of such magnets and to activate the magnets sequentially, with either a fixed or variable time delay between the activation of successive magnets.

Although a particular embodiment of the invention has been described and illustrated herein, it is recognized that modifications, variations, and alternate embodiments may readily occur to those skilled in the art without departing from the spirit of the invention. Thus, it is intended that all such modifications and equivalents to the preferred embodiment are covered by the appended claims.

We claim:

1. A feed system for delivering feedstock to the region of influence of the magnetic field of an eddy current magnet in an electromagnetic eddy current materials separator, comprising a. a conveyor assembly having
   i. a first end and a second end,
   ii. first and second guide means located at said first and second ends,
   iii. a conveyor belt,
   iv. both guide means being operatively connected to the inner surface of said conveyor belt for maintaining said belt under tension,
   v. the first end of the conveyor assembly being disposed adjacent to and upstream of the region of influence of the magnetic field of said magnet, b. means for supplying feedstock to the conveyor apparatus near the second end thereof, c. means for detecting the presence of a blockage preventing feedstock from being delivered by the conveyor to the region of influence of the magnetic field of the eddy current magnet and producing a blockage signal in response to the existence of such blockage, d. means responsive to said blockage signal for lowering or retracting the first guide means.

2. The feed system for delivering feedstock to the region of influence of the magnetic field of an eddy current magnet in an electromagnetic eddy current materials separator as defined in claim 1, further including means to restore the first guide means to its unlowered or unretracted position upon the removal of a blockage.

3. The feed system as defined in claim 1, wherein the means for detecting the presence of a blockage comprises a light source and a photoelectric sensor disposed adjacent the outer surface of the conveyor belt near the first guide means, on opposite sides of the conveyor belt, respectively, whereby particles of material resting on the conveyor belt will intersect the path of light between the light source and the photoelectric sensor.

4. The feed system as defined in claim 1, wherein the means responsive to the occurrence of the blockage signal for lowering or retracting the first guide means comprises a. a fluid actuated cylinder powered by a hydraulic or pneumatic fluid pump and having a piston and a piston rod attached thereto disposed within the hydraulic cylinder, and b. a rigid member operatively connected to said piston rod at a first end thereof and to said first guide means at a second end thereof and pivoted at a fixed pivot point located between said first and second ends thereof.

* * * * *